United States Patent [19]

Woodard, Jr. et al.

[11] Patent Number: 4,695,359

[45] Date of Patent: Sep. 22, 1987

[54] FILTER PRESS MEMBRANE ELECTROLYTIC CELL WITH DIFFUSION BONDED ELECTRODE ELEMENTS AND ELASTOMERIC FRAMES

[75] Inventors: Kenneth E. Woodard, Jr., Cleveland, Tenn.; Robert A. Dean, Guilford, Conn.; David L. Fair, Cheshire, Conn.; Julius C. Fister, Jr., Hamden, Conn.

[73] Assignee: Olin Corporation, Cheshire, Conn.

[21] Appl. No.: 815,697

[22] Filed: Jan. 2, 1986

[51] Int. Cl.[4] ..... C25B 9/00; C25B 11/02; C25B 11/10; B23K 31/02

[52] U.S. Cl. ..... 204/255; 204/257; 204/263; 204/279; 204/290 R; 204/290 F; 228/179

[58] Field of Search ..... 204/252–253, 204/254, 255–258, 279, 263–266, 290 R, 290 F, 286–289

[56] References Cited

U.S. PATENT DOCUMENTS

| | | | |
|---|---|---|---|
| 3,444,608 | 5/1969 | Conn, Jr. et al. | 29/423 |
| 3,493,415 | 2/1970 | Grisaffe et al. | 117/50 |
| 3,789,498 | 2/1974 | Cole | 29/470.9 |
| 4,048,045 | 9/1977 | Eng et al. | 204/257 X |
| 4,220,276 | 9/1980 | Weisert et al. | 228/118 |
| 4,233,831 | 11/1980 | Hamilton et al. | 72/60 |
| 4,269,053 | 5/1981 | Agrawal et al. | 72/42 |
| 4,274,939 | 6/1981 | Bjäreklint | 204/257 |
| 4,303,570 | 12/1981 | Weisert et al. | 260/31.2 R |
| 4,304,350 | 12/1981 | Paez et al. | 228/118 |
| 4,306,436 | 12/1981 | Schulz et al. | 72/21 |
| 4,331,284 | 5/1982 | Schulz et al. | 228/157 |
| 4,402,809 | 9/1983 | Dilmore et al. | 204/255 X |
| 4,402,813 | 9/1983 | Kircher et al. | 204/257 X |
| 4,514,470 | 4/1985 | Rosenthal | 428/662 |
| 4,534,846 | 8/1985 | Woodard, Jr. et al. | 204/290 R |
| 4,571,288 | 2/1986 | Boulton | 204/257 X |
| 4,581,114 | 4/1986 | Morris et al. | 204/254 X |

OTHER PUBLICATIONS

European Patent Publication No. WO84/02537 published Jul. 5, 1984 to Abrahamson et al.

Article entitled "Conductive Adhesives, Inks and Coatings", by Dr. Justin C. Bolger, Robert J. Astile and Silvio L. Morano.

*Primary Examiner*—Donald R. Valentine

*Attorney, Agent, or Firm*—Ralph D'Alessandro; Thomas P. O'Day

[57] ABSTRACT

An electrolytic cell is provided with electrodes which are inserted within electrode frames with internal flow conduits and which are formed by metallurgical bonding, and the use of adhesives and an electrical resistance lowering conductive compound between contact surfaces.

22 Claims, 9 Drawing Figures

FILTER PRESS MEMBRANE ELECTROLYTIC CELL WITH DIFFUSION BONDED ELECTRODE ELEMENTS AND ELASTOMERIC FRAMES

BACKGROUND OF THE INVENTION

The present invention relates generally to electrolytic cells. More specifically, the present invention relates to the improved electrode frames and electrodes that may be employed in electrolytic cells when the electrodes are produced by the metallurgical bonding technique of diffusion bonding and the electrode frames are formed from elastomeric materials.

Chlorine and caustic, products of the electrolytic process, are basic chemicals which have become large volume commodities in the industrialized world today. The overwhelming amounts of these chemicals are produced electrolytically from aqueous solutions of alkali metal chlorides. Cells which have traditionally produced these chemicals have come to be known as chloralkali cells. The chloralkali cells today are generally of two principal types, the deposited asbestos diaphragm-type electrolytic cell or the flowing mercury cathode-type.

Comparatively recent technological advances such as the development of dimensionally stable anodes and various coating compositions, have permitted the gap between electrodes to be substantially decreased or eliminated entirely. This has dramatically increased the energy efficiency during the operation of these energy-intensive units.

The development of a hydraulically impermeable, ion selective membrane has promoted the advent of filter press membrane chloralkali cells which produce a relatively uncontaminated caustic product. This higher purity product obviates the need for caustic purification and decreases the need for concentration processing. The use of a hydraulically impermeable planar membrane has been most common in bipolar filter press membrane electrolytic cells. However, continual advances have been made in the development of monopolar filter press membrane cells. A hydraulically impermeable membrane also has found utility in electrolytic cells other than chloralkali electrolytic cells.

The use of a hydraulically impermeable membrane, however, presents problems should the membrane become structurally damaged, such as ruptured by the passage of a sharp object therethrough. The puncturing of membranes by abrasion or puncturing with sharp electrode components is particularly troublesome since it permits the cross migration of ions between the anode and cathode compartments. This reduces the efficiency of the cell. Frequently the cause of these abrading electrode components are roughened weld surfaces or the unrestrained electrode component that results when a weld on the electrode fails.

The number of welds on an electrode are numerous since each separately formed electrode element must be joined together. These elements include the individual electrode frame members, the electric current conducting elements and the electrode surfaces. The electrode surfaces, typically formed of a mesh, perforated or punched metal, especially have a large number of individually welded connections. Since the ion selective membranes are placed against these electrode surfaces, roughened weld surfaces or broken welds will easily puncture a membrane.

Welding presents the additional problem of building up heat in the electrode components as they are joined together in assembly, frequently causing warpage or distortion that affects the ability of the electrode to function efficiently. Warpage creates a non-planar surface that results in poor or non-uniform current distribution during operation across the electrode surface. This warpage also causes the welds to either fail completely or to be subjected to extreme stress at the weld points when subjected to the assembly pressures necessary to compress and assemble the cell in a configuration that requires planar electrodes.

These membranes are expensive. A commercial-size membrane cell, for example of the filter press type, will have up to twelve or more membranes in each electrolytic cell unit comprising multiple cathode and anode units separated by a membrane. Damaged membranes therefore either require expensive replacements or are time consuming to locate and repair. Consequently, repair or replacement is a costly manual process. The exact position of structurally damaged membranes in the electrolytic cell unit must be identified before they can be replaced.

Damaged membranes can also cause corrosion to occur in the metals used internally within the electrolytic cell by permitting the catholyte fluid with caustic or the anolyte fluid with brine to cross through the ruptured membrane and enter the adjacent electrode compartment. Caustic is extremely corrosive to the anode metals, while the brine with chlorine in the anolyte will dissolve nickel in a cathode, forming a high oxidation state nickel compound that will build up in the membrane. Where titanium is used in the anode, caustic will dissolve it, forming a titanium oxide that will also buildup in the membrane. This metallic ion buildup in the membrane decreases the current efficiency of the cell and increases the cell voltage.

Damaged membranes additionally will decrease the overall efficiency of the operating cell by decreasing the cathode and anode current efficiencies. The cathode current efficiency decreases are detectable in several ways, such as by measuring the weight of the caustic produced in a container vessel, calculating the actual production rate, and then comparing it to the expected production rate. Decreases in anode current efficiency are detectable because of the increase in the presence of oxygen in the cell gas and oxychlorides, such as hypochlorite, or chlorates in the spent anolyte stream, or spent brine, in a chloralkali cell. Changes in the pH of the spent anolyte stream are also indicative of such decreases. Obviously, damage to or ruptures of the membranes reduce the production capacity of the electrolytic unit, affect the quality of the cell product and adversely affect the economics of an operating commercial unit.

Another related disadvantage of electrodes which must be welded together at the joints between various components is the amount of labor involved. Welding, whether TIG welding, resistance welding or spot welding, is labor-intensive and requires sizeable periods of time. It is difficult to adhere to the required tolerances where hand operations such as welding, are performed. These tolerances are most critical in electrolytic cells that have no gap between the membranes and the adjacent cells. Additionally, the welds may not be consistently or uniformly made. The labor-intensive manual welding involved in the fabricating of an electrode significantly increases the cost of each cell. While it has been known for a number of years that certain metals, such as titanium and various alloys, may be metallurgically joined together by applying heat and pressure for a sufficient amount of time to cause intimate surface contact and interdiffusion of the atoms at the joint interface, such technology has not previously been successfully applied to electrolytic cell components. Similarly, while it has been known that certain metals, including titanium and various alloys, exhibit the characteristic of superplasticity or the ability of a material to develop unusually high tensile elongations under conditions of increased pressure and temperature, this process has not been previously successfully applied to the production of electrolytic cells. More recently, the combining of superplastic forming and diffusion bonding technology in making structural components has been accomplished, most notably in the aviation industry.

The cost and weight of the individual electrodes can be reduced if non-metallic materials can be used to fabricate the electrode frames, instead of the traditional metals of nickel, steel or titanium. Such material, for example plastic or ethylene-propylene diene monomer, hereafter referred to as EPDM, with or without polypropylene dispersed thereinto, must be protected from the corrosive effect of the fluids within the cell.

The foregoing problems are solved by the present invention wherein an electrolytic cell is fabricated from electrodes formed by the metallurgical bonding technique of diffusion bonding and the electrode frames are formed from a plastic or elastomeric material with all internal surfaces lined with a layer of protective material. The resulting cell has reduced electrical current flow resistance and a lower final cost.

SUMMARY OF THE INVENTION

It is an object of the present invention to provide an electrolytic cell that employs electrodes utilizing non-metallic frames which have their surfaces which are exposed to electrolyte lined with a layer of protective material.

It is a further object of the present invention to provide an electrolytic cell with an electrode that is fabricated employing the metallurgical bonding technique of diffusion bonding.

It is another object of the present invention to provide an electrolytic cell with an electrode that is fabricated by assembling a diffusion bonded subunit including at least a backplate, conducting elements and an electrode surface to a conducting plate by use of adhesives and a conductive coating that lowers the electrical resistance at the joint between the two electrode components.

It is a feature of the present invention that the surfaces of the elastomeric frames which are exposed to the electrolyte are lined with a layer of protective material to prevent attack by the fluids within the cell.

It is another feature of the present invention that the fluid flow conduits are internal, being integral with the elastomeric frames.

It is another feature of one embodiment of the present invention that the backplate, the conductor elements and the electrode surface form a subunit that are connected at joints by the metallurgical bonding process of diffusion bonding.

It is yet another feature of the present invention that the diffusion bonded subunit of the backplate, conducting elements and electrode surface has its electrode surface separately catalytically coated to form the activated surface for use during electrolysis.

It is still another feature of the present invention that the diffusion bonded subunit with its backplate, conductor elements and catalytically coated active electrode surface is mated to a conducting plate or surface by means of an adhesive and a conductive coating that lowers the electrical resistance at the joint or interface between the two electrode components.

It is an advantage of the present invention that the electrode frames are flexible and lower in cost than conventional metal frames.

It is a further advantage of the present invention that an electrode is obtained by the metallurgical bonding process of diffusion bonding which eliminates rough spots that could puncture the membrane in the assembled electrolytic cell.

It is another advantage of the present invention that the amount of manual labor necessary to produce an electrode is dramatically reduced.

It is still another advantage of the present invention that an electrode is obtained which is smooth at the joints between the individual components and is lower in weight and cost.

It is yet another advantage of the present invention that heat distortion in the electrode produced by the process of diffusion bonding is more easily controlled than by conventional fabrication steps.

It is a further advantage of the present invention that warpage of the electrodes is avoided and the required tolerances are maintained in an electrode produced by the subject process.

These and other objects, features and advantages are obtained in an electrolytic cell which utilizes non-metallic frames with surfaces that are exposed to electrolyte lined with a layer of protective material and electrodes produced by the process of diffusion bonding the joints of the separate components and the individual electrode together to form an electrode subunit consisting of a backplate, conducting elements and an electrode surface, the electrode subunit being mated to a conducting plate by an adhesive and a conductive coating that lowers the electrical resistance at the joint or interface between the backplate and the conducting plate.

BRIEF DESCRIPTION OF THE DRAWINGS

The advantages of this invention will become apparent upon consideration of the following detailed disclosure of the invention, especially when it is taken in conjunction with the accompanying drawings wherein.

DETAILED DESCRIPTION OF THE PREFERRED EMBODIMENT

Figure 1:
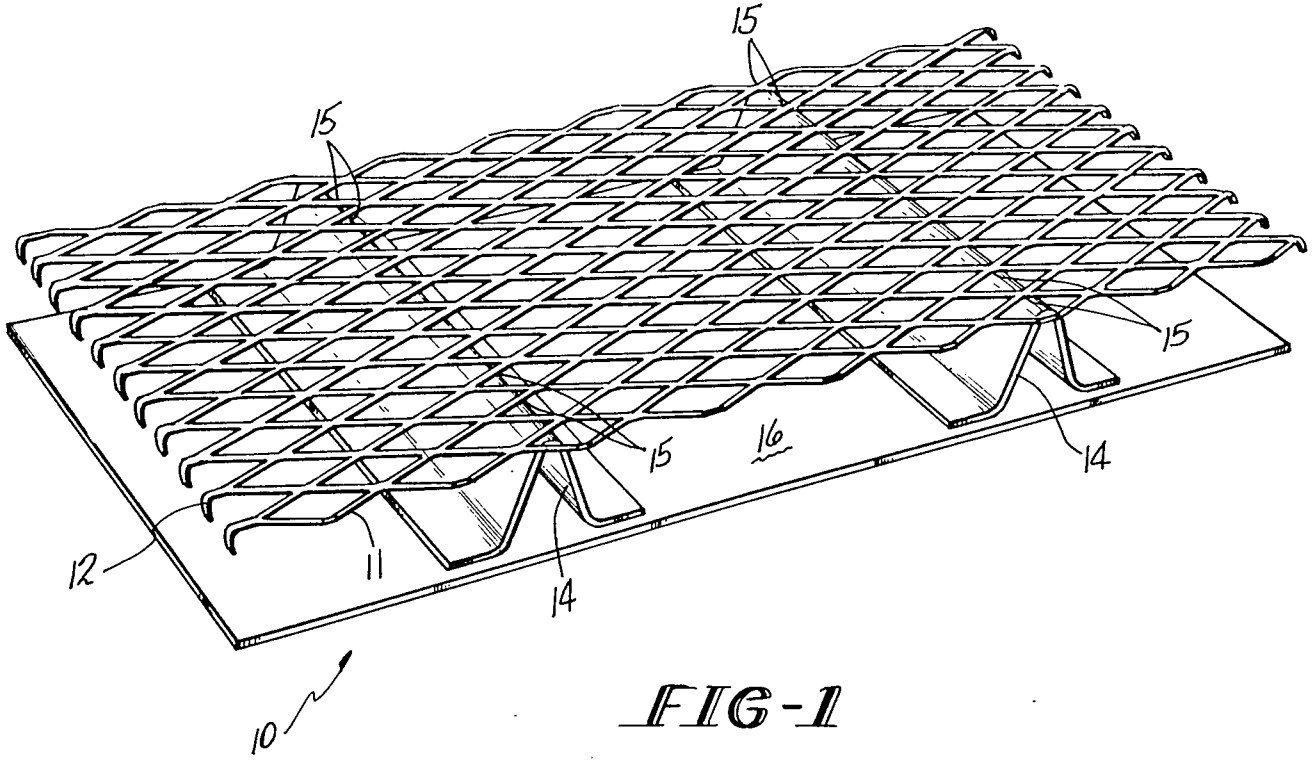
FIG. 1 is a front perspective view of an electrode subunit produced by the metallurgical bonding process of diffusion bonding.

FIG. 1 shows a front perspective view of an electrode subunit indicated generally by the numeral 10 that is formed by the process of diffusion bonding. The electrode subunit 10 includes an electrode surface 11 that is shown as being a wire mesh. This electrode surface 11 may be formed from an expanded metal mesh which is flattened or unflattened, perforated or punctured sheets, flat sheets, or sheets having slits or louvered openings. The electrode surface 11 could also be formed from a series of rods that are metallurgically bonded to the conducting elements 14. An expanded metal mesh is a preferred form. The electrode surface 11 may be turned downwardly at its extremities 12 to prevent rough edges from coming into contact with a membrane in an assembled electrolytic cell.

The electrical conducting elements 14 are connected to the electrode surface 11 at a plurality of individual locations or joints 15 by metallurgical bonding, such as diffusion bonding. The conducting elements 14 may be in the form of hollow concave-shaped ribs, hollow tubes, or solid straight bars with or without holes. If holes are employed, they are intermittently spaced to permit fluid passage. The bottom surfaces of the conducting elements 14 are metallurgically bonded by the diffusion bonding process to the backplate 16.

Where the subunit 10 is to be used as an anode in an electrolytic cell, the electrode surface 11, the electrical conducting elements 14, and the backplate 16 are fabricated from a conductive metal such as titanium or tantalum, columbium, niobium, but which is preferably titanium or titanium alloy. Although Grade 7 titanium is preferred, it is possible to use Grade 1 or 2. Grade 12 is preferred when superplastic forming is employed to shape the subunit components. These grades of titanium are established by the ASTM Standard B 265-79. Titanium is especially useful where electrolysis of alkali metal chloride brines is involved. Other suitably fabricated conductive metals could include copper, nickel, silver, steel, magnesium or aluminum and alloys of these metals for electrodes as long as they are compatible in the type of electrolytic process in which they are employed. Copper sputtered onto titanium in a coating with a thickness of about 1000 Angstroms to about 20,000 Angstroms can also be employed to reduce the oxide formation that tends to occur on the metal over time. This oxide formation increases the electrical resistance at the joint or between the mated surfaces of metal.

Where the subunit 10 is to be used as part of an electrode that serves as a cathode, the components are preferably fabricated from a nickel material, such as nickel 200. A nickel 301 that is precipitation hardened can also be satisfactorily used for the cathode conductive metals, as well as steel, stainless steel, nickel, copper or coated conductive materials such as nickel coated copper.

Figure 2:
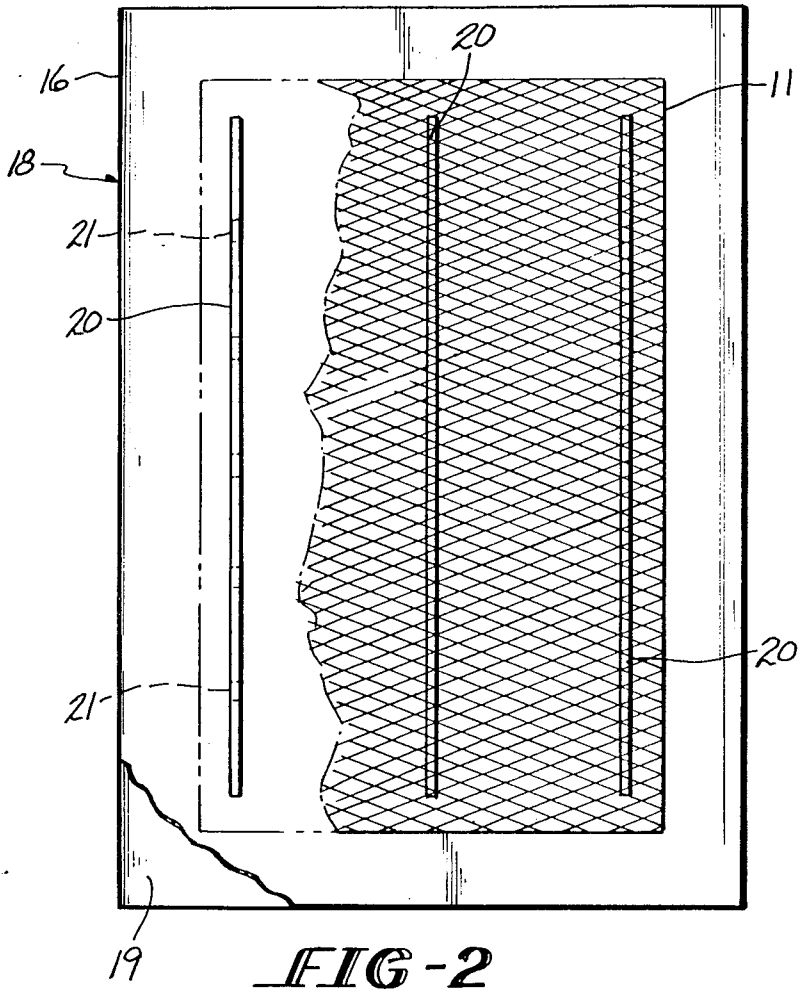
FIG. 2 is a top plan view of an electrode of the present invention with a portion of the electrode surface and the backplate broken away.

FIG. 2 shows an electrode subunit 18 with the backplate 16 bonded to a generally planar mating conducting plate 19 formed of copper because of its conductive qualities and relative low cost. The e1ectrode subunit 18 has electrical conducting elements in the form of blades 20 which connect backplate 16 to the electrode surface 11. The electrical conducting elements or blades 20 have passages 21 therethrough to permit electrolyte to flow through the channels between the backplate 16 and the membrane (not shown) in an assembled cell. The blades 20 extend generally vertically from bottom to top in an assembled cell when the electrode is in an operating position. The blades 20 could equally well be horizontally or obliquely oriented in an assembled cell.

An adhesive is applied to the backplate 16 and/or the conducting plate 19 after appropriate surface preparations. These surface preparations include a cleaning to remove the presence of any oxides, degreasing and the removal of any other surface contaminants. The oxides can include oxides of titanium, nickel, zirconium, tantalum, vanadium, or other base metals. Where the electrical conducting elements are in the form of blades 20, the blades are milled for proper sizing and drilled to provide the passages 21. Cleaning must then be accomplished to remove any cutting fluids remaining from the milling and drilling operations. This cleaning consists of immersing or dipping in an alkaline solution or organic solvent, or immersing or dipping in a dilute acid. Alternately, the cleaning agent can be brushed on. The cleaning agent is then rinsed or removed from the applicable surfaces by either immersion or spot rinsing.

Figure 3:
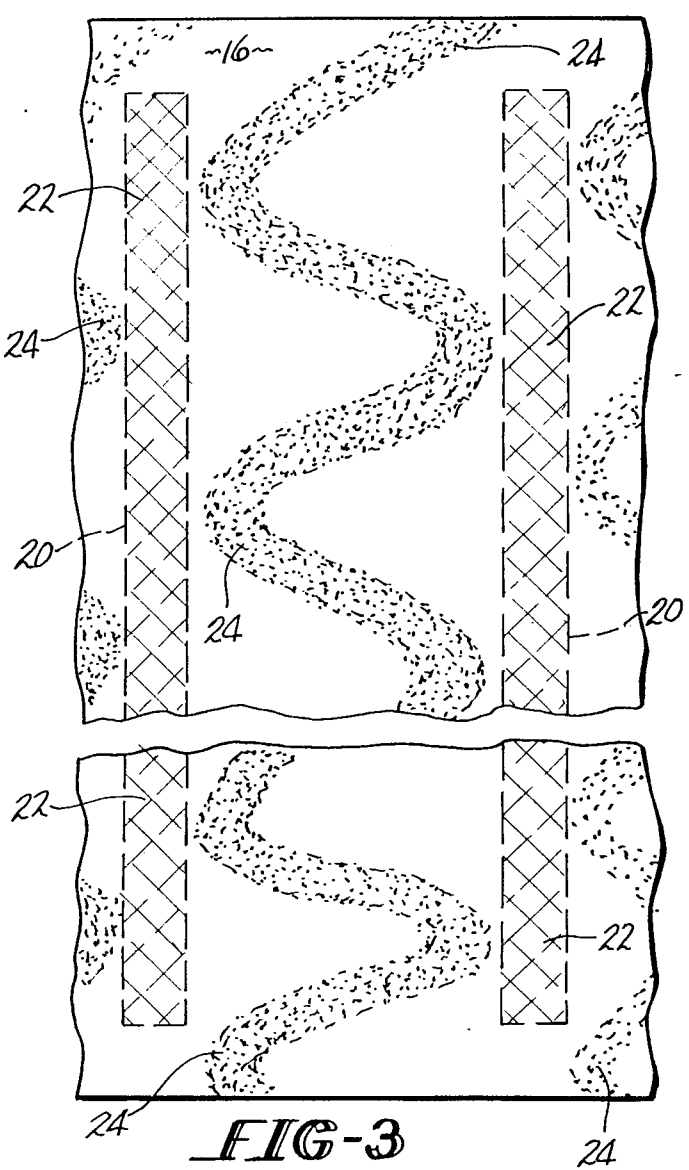
FIG. 3 is a top plan view of a portion of the reverse side of the electrode of FIG. 2 showing the location of the adhesive and the electrical resistance lowering conductive coating applied to the backplate to fasten the electrical conducting plate thereto.

Thus prepared and as illustrated in FIG. 3, a conductive coating 22 of a liquid metal mixture comprised of between about 20 and about 30% by weight indium and between about 70 and 80% by weight gallium, preferably between about 23 and about 26% by weight indium and between about 74 and 77% by weight gallium, is applied to the reverse side of backplate 16 in line with the conducting elements or blades 20 that have been previously metallurgically bonded to the backplate. This conductive coating is a eutectic having a melting point of approximately 15.7° C. at the eutectic composition of 24.5% by weight indium, so it can be easily applied to the surfaces even at room temperature. The conductive coating 22 does not immediately amalgamate or otherwise bond the backplate 16 to the conducting plate 19. The conductive coating 22 is applied preferably in a one inch wide strip by wiping on with a suitable applicator, such as a paint brush, swab or wiping cloth. As described in U.S. Pat. No. 4,434,846 to Woodard et al, herein specifically incorporated by reference in pertinent part, the conductive coating 22 serves to reduce the electrical contact resistance between the conducting plate 19 and the backplate 16.

The conductive coating 22 generally is not intended to function as a bonding agent and, in fact, subsequent data will show a lack of bonding between adjacent mating surfaces. However, it was found that the conductive coating by itself will bond the backplate 16 to a conducting plate 19, for example, when subjected to a temperature of about 90°C., a minimal pressure of about 10 psi, and aged for 3 days. These are conditions that occur during normal operation of a filter press membrane type of a cell. It is thus possible for an electrolytic cell to be assembled without the use of a specially selected adhesive and have some bonding occur after normal use.

An adhesive 24 preferably is applied to the backplate 16 between the electrical conducting elements or blades 20 in any pattern or uniformly. As seen in FIG. 3, it is applied in an illustrative Z-type pattern. The adhesive 24 is also applied to the backplate 16 outside of the blades 20. This application pattern permits the adhesive 24, when compressed by having the backplate 16 mated to the conducting plate 19, to be dispersed and spread out to cover substantially most of the contact surface area between the backplate 16 and the conducting plate 19.

The adhesive 24 may be one of several types of conductive or non-conductive adhesives. It may be a silver-filled epoxy, a copper-filled epoxy, a silver coated copper-filled epoxy, a tin-lead solder mix in paste form or preformed strips, a tin-silver solder mix in paste form or preformed strips, or a non-conductive epoxy, as will be explained hereafter. Whether the adhesive 24 is conductive or non-conductive, its use obviates the need for time-consuming, labor-intensive welding which can cause heat distortion in the backplate 16 or the conducting plate 19 due to heat buildup.

The adhesive 24, when non-conductive, can be a clear, low viscosity two-component epoxy adhesive system that contains no solvent and cures quickly at room temperature. Commercially available two-component epoxy adhesives of this type serve as excellent thermal and electrical insulators with chemical resistance to aqueous solutions and other chemicals. Such non-conductive adhesives, when mixed in a one to one ratio by weight or volume, cure at ambient temperatures within 24 hours, but bonding can be accelerated to about 4 hours when cured at about 160 to about 170 F. One component epoxy adhesive systems may also be employed, as suitable.

Silver-filled two-component conductive epoxy coatings may also be employed which exhibit high electrical conductivity and heat resistance after curing. Such adhesives can be employed by brushing, spraying or screen printing in coatings of two mils or less. Such adhesives are heat cured generally at temperatures from about 80° C. to about 150° C. for about two hours to about 3 minutes, dependent upon the particular formulation employed.

Copper-filled adhesives may be employed that are paste like in consistency and which will cure in about 30 minutes to about 120 minutes at temperatures at about 150° C. or about 125° C.

The solder mix may be a commercial paste formulation that contains about 95% tin and about 5% silver by weight, or alternately about 60% tin and about 40% lead by weight mixed with a flux. These type of solder pastes are especially useful in wetting copper and nickel.

The metallurgical bonding process of diffusion bonding is employed on the electrode subunits 10 and 18. The backplates 16, electrode surfaces 11, and the electrical conducting elements 14 and 20 are milled and cut to the proper size. Then they are cleaned to remove the oxides or other contaminants previously described from the contact surface areas. This cleaning is accomplished by the aforedescribed techniques. After drying, any areas not to be bonded, such as the areas to be subjected to superplastic forming, are coated with an appropriate stop-off compound, such as boron nitride, yttria, alumina or other stable oxides. The subunit 10 or 18 is placed in an appropriate mold or workpiece in a vacuum chamber which is heated and maintained at a temperature that is optimum for the metals being formed and bonded together. Diffusion bonding temperatures can vary from about 787° C. to about 1010° C. For an electrode formed of titanium, the temperature can be preferably between about 815° C. to about 898° C., while an electrode formed of a nickel will preferably range from about 871° C. to about 954° C. The heat is provided within the press or workpiece, for example, by resistance-heated nichrome wire that may be embedded in ceramic platens. Other portions of the tooling may be formed of stainless steel.

The tooling serves as a press to maintain the structure being bonded under pressure that can vary from about 100 pounds per square inch (psi) to about 2000 psi or more, preferably from about 150 psi to about 650 psi over a time period of 30 minutes to about 15 hours. The pressure may be applied hydraulically or by a gas that may also protect against surface enrichment of the metals being bonded. For example, argon gas or helium may be employed. The tooling or platens may be held together in counter resistance to the internal forces by hydraulics. This process will permit the electrode subunits 10 or 18 to be bonded together in all areas except where the stop-off compound has been applied. Once subjected to sufficient pressure and for a sufficient length of time, the subunits 10 or 18 are allowed to cool and are removed from the press and tooling.

If it is desired to superplastically form some of the components of the electrode subunit, such as the electrical conducting elements 14 of subunit 10, the subunit 10 is left in the press after the diffusion bonding temperature and time cycle has been completed. The bonding occurs to the unstopped-off areas. Gas pressure is increased by introduction of an appropriate inert gas into the tooling area at a controlled rate until a breakthrough in the stopped-off area occurs so the gas creates a flow path to the stopped-off areas. This causes the areas to be superplastically and uniformly formed, while avoiding strain rates in excess of the superplastic range of the material being formed. It is desirable to have a low breakthrough pressure-time product, such as less than 100 psi-minutes. The combined superplastic forming and diffusion bonding operation is described in detail in U.S. Pat. No. 3,927,817.

In the case of the electrode subunit shown in FIG. 1, diffusion bonding and superplastic forming can be employed to fabricate subunit. The electrode surface 11 and the electrical conducting element 14 are diffusion bonded to the backplate 16, except where the stop-off compound has been applied to permit breakthrough to occur. The A-shaped configuration of the electrical conducting elements 14 are obtained by superplastic forming of the components. It may be necessary to first diffusion bond the backplate 16 to the unstopped-off areas of the electrical conducting elements 14 prior to superplastic forming these elements. It may then be necessary to diffusion bond the electrode surface 11 to the superplastically formed conducting elements 14. A copper conducting plate of the type shown in FIG. 2, may then be appropriately bonded to the backplate 16.

Alternately, an electrode could be fabricated without the backplate 16 by directly bonding the unstopped-off areas of the electrical conducting elements 14 to a conducting plate 19.

The electrode surfaces are then ready to be coated with a high surface area coating or an activated coating, such as any of the commercially available catalytic coatings, for example those prepared by thermal decomposition, electrodeposition, sputtering, vapor phased deposition, or ion implantation. The application of the high surface area or activated or catalytic coatings to the electrode surfaces 11 at this point in the process has the additional advantage of employing a coating application temperature cycle that is lower than that employed in the diffusion bonding operation. Minimum warpage occurs in the electrodes and tolerances in the electrodes thus can be maintained. The catalytically active coatings may be selected from the group consisting of lanthanum, pentanickel, Raney-nickel, precious metals, precious metal oxides, electroplated alloys of nickel and leachable metals of zinc, cadmium or aluminum. The precious metals and the oxides thereof are defined as being taken from the group consisting of platinum, palladium, iridium, ruthenium, osmium, rubidium and indium.

Figure 5:
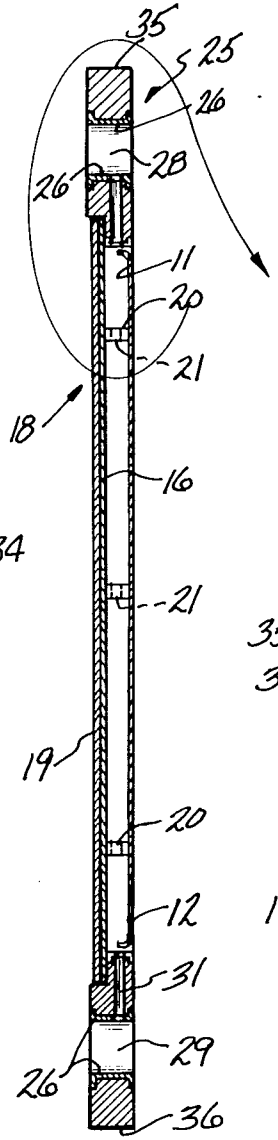
FIG. 5 is a sectional view taken along the lines 5—5 of FIG. 4 with an electrode subunit mounted in place to show the positioning of the electrode subunit and the electrode surface in the electrode frame of FIG. 4.
Figure 4:
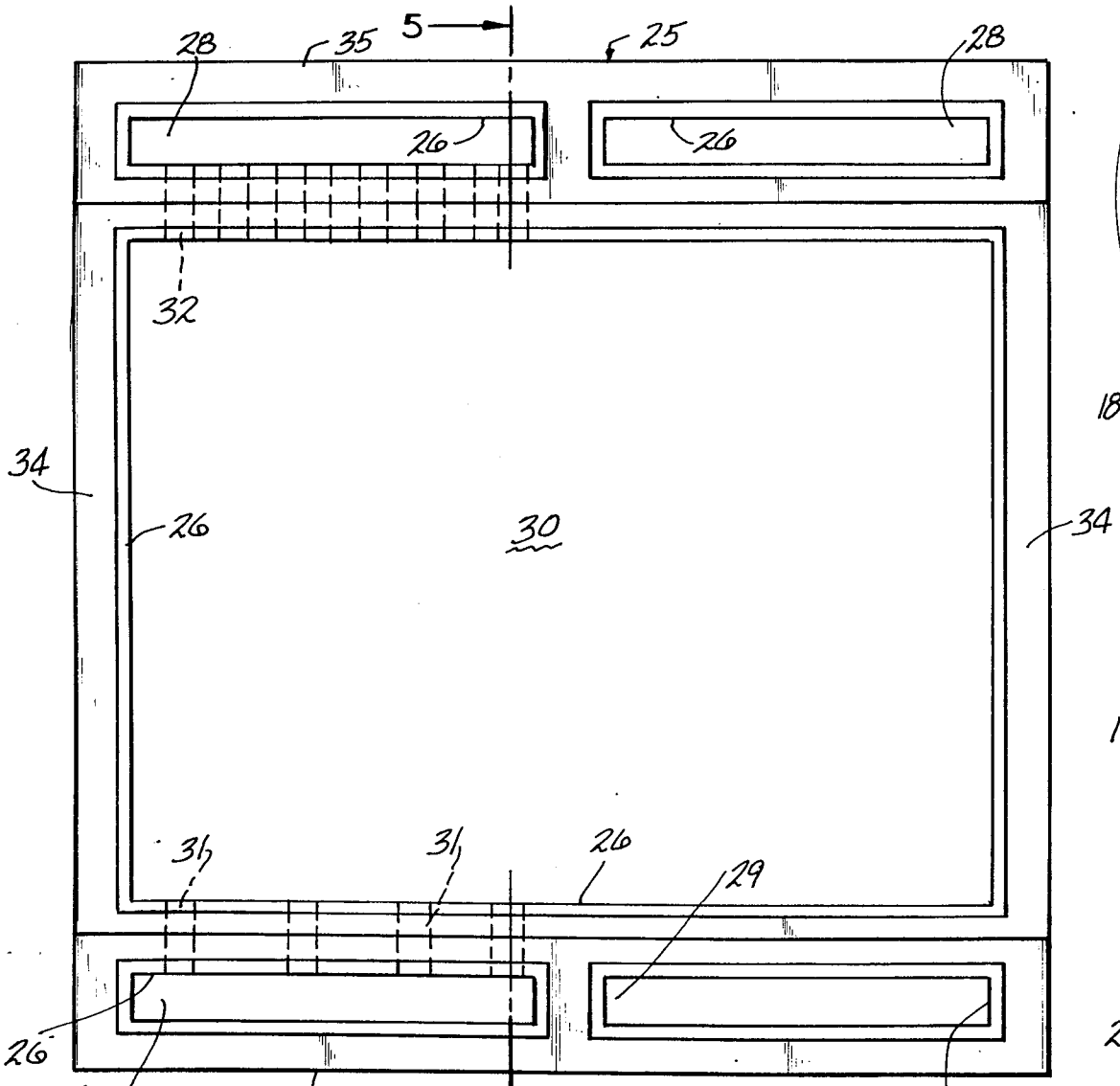
FIG. 4 is a side elevational view of an elastomeric electrode frame with the surfaces which are exposed to the electrolyte lined with a layer of protective material and which uses internal fluid flow conduits.

An electrode subunit, such as the subunits 10 and 18, are inserted into an electrode frame, indicated generally by the numeral 25 in FIGS. 4 and 5. As best seen in FIG. 4, frame 25 is made of an elastomeric material that gives it some flexibility, but has its surfaces which are exposed to the electrolytes coated with a layer of protective material or lining 26 which protects the elastomeric material from the corrosive action of the fluids within the cell. The protective lining preferably is made from a fluoroplastic material, selected from the class of paraffinic polymers sold under the tradename TEFLON, including polytetrafluoroethylene (PTFE), fluorinated ethylene propylene (FEP) copolymer, and perfluoroalkoxy (PFA) resin. Protective material or lining 26 lines the internal flow conduits 28 and 29 at the top and bottom of the frames 25, as well as the interior of the central space 30 within which fits the electrode subunit 18.

The bottom internal flow conduits 29 are connected to the central space 30, into which the electrode subunits 10 or 18 fit, by flow passages 31. These flow passages 31 permit the electrolytes, whether anolyte or catholyte fluid, to be fed into the assembled electrode in the cell and to pass upwardly into the area where electrolysis occurs within the central space 30.

Electrolysis occurs at the electrode surface 11 in the central space 30 in an assembled electrolytic cell when the electrode subunit, for example subunit 18, is inserted within the frame 25, as best seen in FIG. 5. The electrolysis, for example in the case of a chlor-alkali filter press membrane electrolytic cell, produces fluid products which must exit the cell. In the electrode for the filter press membrane cell of the instant design, the product fluids rise upwardly out of the central area 30 into the top internal flow conduits 28 of FIGS. 4 and 5 through upper internal flow passages 32. In the specific type of electrolytic cell being illustrated here, chlorine gas is generated at the anode and rises upwardly through the upper internal flow passages 32 in the anode frame, while hydrogen gas and caustic soda is generated at the cathode and is released to rise upwardly into the internal flow passages 32 of the cathode frame.

Figure 6:
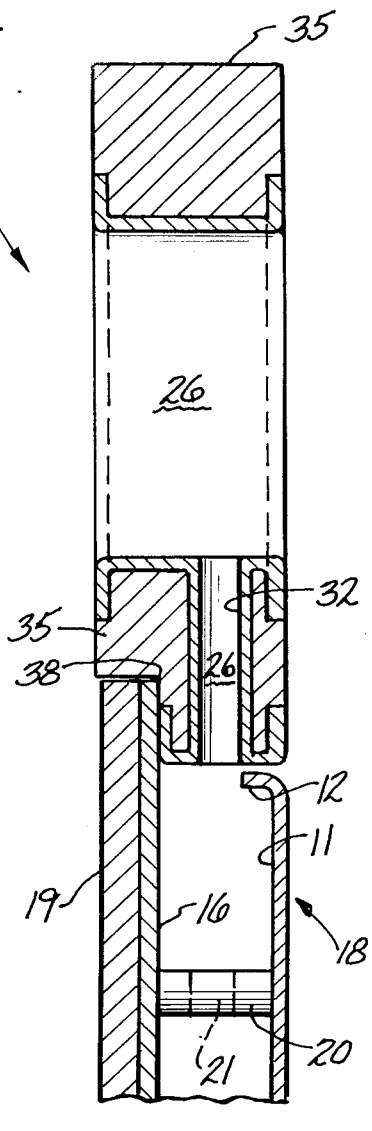
FIG. 6 is an enlarged sectional view of a portion of the assembled electrode of FIG. 5.

As seen in FIGS. 4, 5, and partially in FIG. 6, the electrode frame 25 consists of two parallel and generally vertically extending side members 34. These vertical side members 34 are connected to two generally parallel upper and lower sections, 35 and 36 respectively, which have the internal flow conduits there. The frame 25, with its side frame sections 34 and its top and bottom frame sections 35 and 36, is formed from a pliant flexible material, such as ethylene-propylene diene monomer (EPDM). As mentioned previously, the internal surfaces of the electrode frame 25 which may be in direct contact with the corrosive electrolytes are lined with a layer of protective lining 26, which may appropriately be fastened or bonded to the appropriate frame elements, such as by the use of adhesives.

The frame 25 shown in FIG. 4 will have the upper internal flow passages 32 into one of the upper internal flow conduits 28 and the bottom flow passages 31 into one of the bottom internal flow conduits 29 either in line or above each other on the same side of the frame 25 as illustrated, or on opposite sides in a cross flow pattern. The frame 25 can be grooved about each of the bottom internal flow conduits 29 and the upper internal flow conduits 28 to receive a gasket or seal, such as an O-ring, to facilitate forming liquid-tight seals around these conduits between adjacent frames in an assembled cell.

As seen in FIG. 5, the electrode surface 11, attached to the electrode subunit 18, is inset within the frame 25. This type of assembly permits the ion selective membrane in an assembled electrolytic cell to be placed between adjacent electrode frames 25 either directly in contact with the electrode surface 11 or a finite gap distance therefrom.

FIGS. 5 and 6 show how the lower internal flow passages 31 and the upper internal flow passages 32 are also lined with the protective lining 26. These FIGURES also illustrate how the electrode frame can be stepped with an incut 38 to have the electrode subunit 18 fit firmly thereinto. As illustrated in FIGS. 5 and 6, however, only a half electrode with one electrode surface 11 is shown. It is equally possible to have an electrode subunit with two electrode surfaces attached thereto on opposing sides that can fit within the electrode frame 25. It is preferred, however, to utilize two frames 25, one frame for each electrode surface 11, as seen in FIG. 7.

Figure 7:
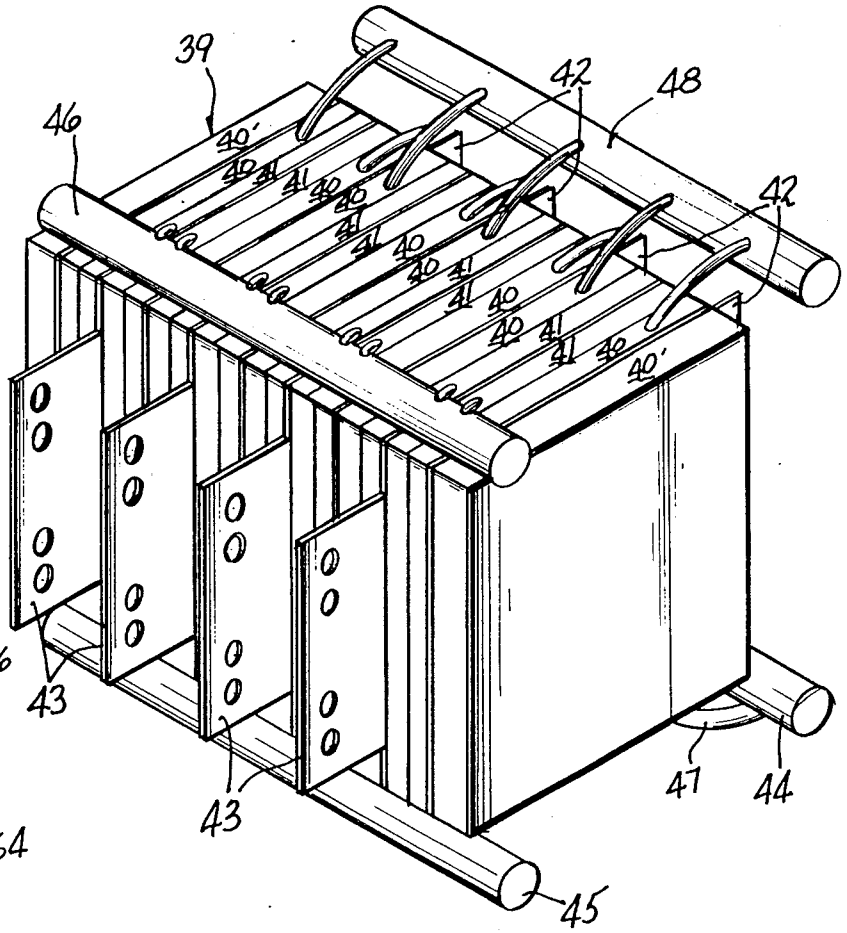
FIG. 7 is a perspective view of a monopolar electrolytic cell employing external electrolyte headers and non-metallic electrode frames with the surfaces which are exposed to the electrode lined with a layer of protective material and in which are mounted electrode subunits produced by the metallurgical bonding process of diffusion bonding.

FIG. 7 illustrates a perspective view of a monopolar electrolytic cell, indicated generally by the numeral 39, employing non-metallic frames with the protective lining 26 previously described protecting the surfaces which are exposed to the electrolytes. Cell 39 has paired alternating cathode frames 40 and anode frames 41, with the appropriate electrode subunit 18 inserted thereinto, separated by ion selectively permeable membranes (not shown). End frames 40' are paired with the end cathode frames 40 on each end of the cell 39 since the cathode units are only half electrodes on the ends, that is there is only one cathodic electrode surface on each end of the cell 39. The remainder of the cathode frames 40 are adjacently paired, as described above. The cathodes have electrical buses 42 and the anodes have electrical buses 43 attached thereto which may be connected to adjacent cells in series and to an electrical power source to transmit the electrical energy through the cell to perform electrolysis.

Cell 39 has an external electrolyte circulation system utilizing a brine header 44 which is connected to each anode frame 41 by a bottom anode infeed pipe 47, only one of which is shown in FIG. 7. A deionized water and caustic header 45 feeds into the bottom of each cathode frame 40 via a bottom cathode infeed pipe (not shown).

Product chlorine exits the anode frames 41 via anode outlet pipes 57 into the chlorine header 48. Similarly, product hydrogen gas and caustic exits the cathode frames 40 via cathode outlet pipes 58 into the hydrogen/caustic header 46.

Figure 9:
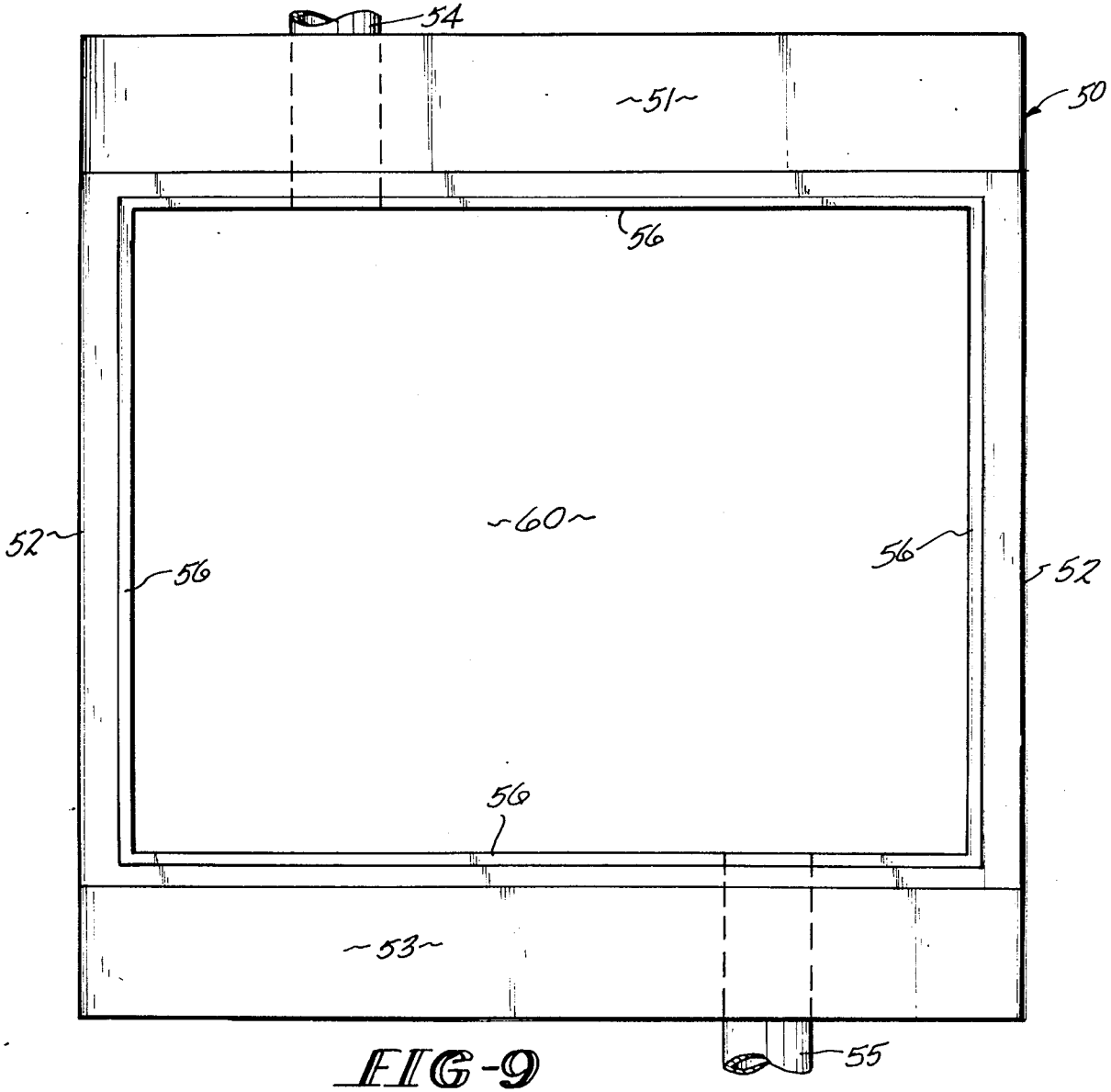
FIG. 9 is a side elevational view of a frame utilizing top outlet conduit and bottom inlet conduit.

A typical electrode frame, indicated generally by the numeral 50, employed in cell 39 is shown in FIG. 9. Frame 50 has a top section 51, a bottom section 53 and two side sections 52, which are made of a non-metallic material such as plastic or an elastomer. A layer of protective material or lining 56 is bonded to the frame material about the inside surfaces of the central space 60 to protect the surfaces from the electrolyte, as previously described. Product fluids exit the frame 50 by passing upwardly through a top outlet conduit 54, which connects with the appropriate outlet pipe 57 or 58 to feed to the correspondingly appropriate header 46 or 48. Similarly, on the bottom of the frame 50 bottom inlet conduit 55 connects to the appropriate bottom infeed pipes to feed the brine or deionized water/caustic into the correspondingly appropriate electrode frame.

Frames of the cross-flow type shown in FIG. 9 as frame 50 can be employed in half of the frames of cell 39. The other half of the paired anodes and cathode frames would have their stepped incuts, previously described with respect to FIGS. 5 and 6, reversed so the backplates 19 of the electrode subunits 18 would be adjacent one another in the paired alternating cathode and anode sequence.

Figure 8:
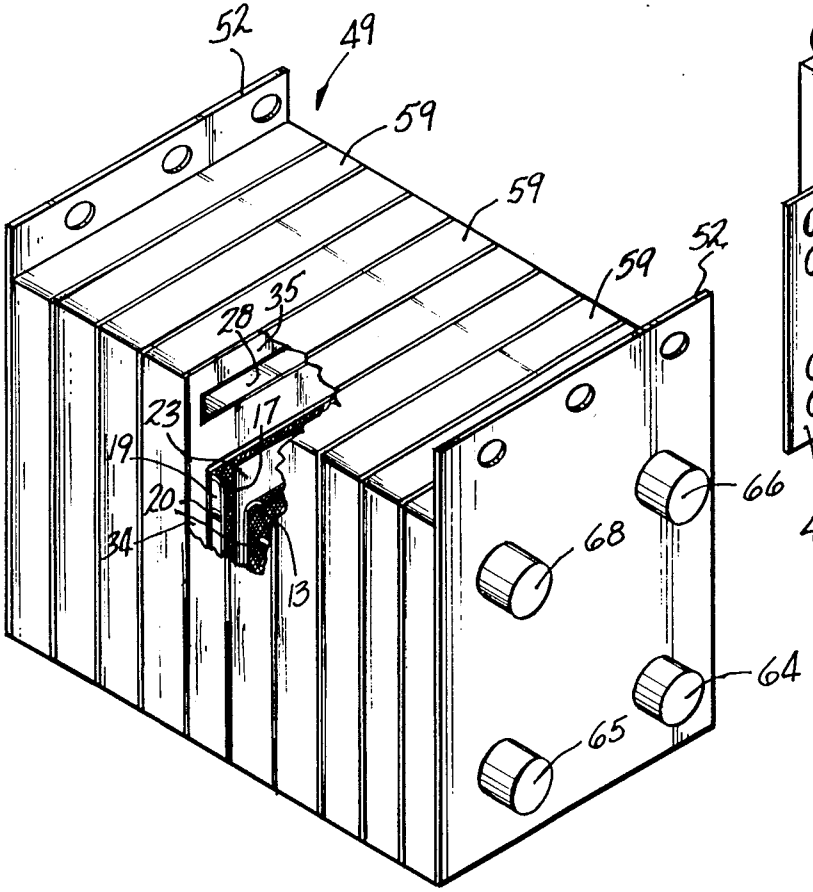
FIG. 8 is a perspective view of a bipolar electrolytic cell employing elastomeric electrode frames with the surfaces which are exposed to the electrolyte lined with a layer of protective material and in which are mounted electrode subunits produced by the metallurgical bonding process of diffusion bonding.

FIG. 8 shows a perspective view of a bipolar electrolytic cell, indicated generally by the numeral 49, employing elastomeric electrode frames 59 of the type shown in FIG. 4, which have in opposing adjacently paired electrode frames an anode electrode surface 13 and a cathode electrode surface 17. Electrical energy is feed into and removed from the cell by a pair of end buses 52. As described with respect to the monopolar filter press cell 39, the adjacent electrodes are separated by an ion selectively permeable membrane 23 which does not extend into the top and bottom internal flow conduits 28 and 29, shown in FIGS. 4 through 6.

The same type of electrode frame 25 as seen in FIGS. 4 and 5 can be employed in the bipolar cell 49 of FIG. 8 as in a monopolar cell. In this FIGURE they are shown as frames 59. The difference is found in the electrode subunit inserted within each of the adjacently paired frames 59 as to whether the cell is a monopolar or bipolar cell. Monopolar cells have both adjacently paired electrode surfaces in each adjacently paired electrode subunits of the same composition, i.e. both anode surfaces or both cathode surfaces. Bipolar cells of the type illustrated in FIG. 8, on the other hand, have an anode electrode surface in one of the adjacently paired frames and a cathode surface in the other.

The brine header 64 and the deionized water infeed line 65 are shown in FIG. 8 feeding into the cell 49 in line with the bottom frame sections 36 (not shown) to connect into the bottom internal flow conduits 29 of the individual electrode frames 25. The chlorine header 66 and the hydrogen gas/caustic outlet line 68 are shown extending outwardly from the cell 49 in line with the top internal flow conduits 28. Appropriate couplings, not shown, are used to connect from the generally rectangular internal flow conduits 28 and 29 formed by the adjacent positioning of the top flow conduits 28 and the bottom flow conduits 29 in the adjacent cathodes 40 and anodes 41. The membranes would be placed between the adjacent frames 25, but would not extend into the top or bottom internal flow conduits 28 and 29, respectively.

The electrode frames 25 of FIGS. 4 and 5 have the advantage of being usable with either monopolar or bipolar cells. When used in monopolar cells, the same frames 25 may be used for the anode and the cathode electrodes because of the symmetry of the frames. The frames 25 only need to be reversed to permit the infeed electrolytes and the product electrolytes to flow into and rise out of the appropriate electrolytic chamber.

In order to exemplify the results achieved, the following Examples are provided without any intent to limit the scope of the instant invention to the discussion therein.

EXAMPLE I

A 1"×2" coupon of copper alloy C-110 approximately 0.045 inches thick, a 1"×2" coupon of nickel 200 commercial grade approximately 0.055 inches thick, and a 1"×2" coupon of Grade 1 titanium approximately 0.0385 inches thick with copper sputtered on one side were deburred along the edges and cleaned as described hereafter. The coupons were vapor degreased. The copper and copper sputtered titanium coupons were cleaned in a 12% $H_2SO_4$ solution for about 10 seconds at room temperature and then rinsed in distilled water and dried. The nickel 200 coupon was cleaned in a solution of about 37.8 milliliters of water, 56 milliliters of $H_2SO_4$ and 85.2 milliliters of $HNO_3$ at a temperature of about 20° C. to about 35° C. for 10 seconds, rinsed with distilled water and dried.

A thin layer of 95% tin—5% silver by weight solder paste was applied to the coupons and the coupons were mated, loaded in a press to a pressure of approximately 100 psi and heated to about 270° C. for about 10 minutes. The coupons were then cooled to below about 200° C. while under pressure. Kelvin clips were attached to the free end of the couples for measurement of the electrical resistance with a Biddle digital resistance meter. The readings thus recorded measured the serial resistance comprising the resistance from the two mating components in the couple and the junction between the two components. The joint resistance is measured in milliohms. The shear stress of the bond between the couples was also noted. These data are recorded in Table 1. No bonding was achieved with the copper and copper sputtered titanium coupons.

EXAMPLE II

A copper-filled, single-component, high strength adhesive designed for use in microelectronic applications was evaluated by application to coupons of the same composition and dimension as recited in Example I above. The coupons were cleaned according to the procedure described in Example I. Once cleaned, a thin layer of the copper-filled adhesive was spread on the clean surfaces and the surfaces were mated. The mated surfaces were then loaded in a press to approximately 100 psi and were cured at a temperature of about 170° C. to 180° C. for about 30 minutes. This adhesive resulted in a joint with a somewhat elevated electrical resistance for the copper and copper sputtered titanium couples, but with excellent shear strength. The results are also shown in Table 1.

EXAMPLE III

Coupons of the identical size and material were selected and cleaned as described in Example I above. A conductive coating of between about 20 and 30% by weight indium and between about 70 and 80% by weight gallium was applied to one of the coupons and the pairs identified in Table 1 were mated together. The conductive coating reduces the electrical resistance at the joint or interface between the couples. The couples were loaded in a press to approximately 100 psi and cured for about 16 hours from about 195° C. to about 200° C. Reduced electrical resistances were recorded as shown in Table 1, using the same measuring techniques as described with respect to Example I, but no bonding between the couples took place.

TABLE 1

CONTACT SURFACE PROPERTY SUMMARY

| Bonding Adhesive | Electrical Resistance (Milliohms) | Shear Stress Load (pounds) (1" × 1" Lap Joints) |
|---|---|---|
| Ni/Cu Couples | | |
| Copper-filled Single-component Adhesive | 0.19 | 1310 |
| 95% Sn—5% Ag Solder Paste | 0.09 | 1590 |
| Low Electrical Resistance Conductive Coating | 0.19 | No Bond |
| Cu Sputtered Ti/Cu Couples | | |
| Copper-filled Single-component Adhesive | 0.95 | 1320 |
| 95% Sn—5% Ag Solder Paste | Did not wet Cu sputtered Ti | No Bond |
| Low Electrical Resistance Conductive Coating | 0.66 | No Bond |

EXAMPLE IV

Coupons of the identical size, grade and thickness were selected and cleaned as described in Example I. An additional 1"×1" titanium coupon of Grade 1 with a thickness of about 0.039 inches was also selected, cleaned and mated with a matching copper coupon. The coupons were not bonded together by a specific adhesive. Table 2 shows the effect of aging on the electrical joint resistance of couples of different composition. The resistance is measured in milliohms. The couples were aged at about 90° C. temperature and 10 psi loading. Table 2 compares the electrical resistance of unbonded couples not employing a conductive coating with couples employing a conductive coating of the type described in Example III that lowers the electrical resistance at the joint or interface between the coupons. Those couples employing the conductive coating show significantly lower electrical resistance. The conductive coating appears to prevent or significantly hamper the oxidation of the mating contact surfaces that can significantly increase joint resistance with aging. The copper-copper sputtered titanium coupons employing the conductive coating showed decreases in electrical resistance with aging. Those coupons mated without the electrical resistance lowering conductive coating on the copper-copper sputtered titanium coupons have ranges for the resistances recorded at 11 and 17 days because of the multiple coupons tested and the large difference in readings. The copper coupons mated without the conductive coating showed some reduction in the measured resistance with aging because of what is thought to be attributed to the formation over time of copper oxides which exhibit semiconductor qualities.

TABLE 2

CONTACT SURFACE STUDY

| Aging Time (Days) | Resistance (milliohms) Cu/Cu | Cu/Ni | Cu/Cu Sputtered Ti | Cu/Ti |
|---|---|---|---|---|
| Couples With Electrical Resistance Lowering Conductive Coating | | | | |
| 1 | 0.051 | 0.21 | 0.98 | — |
| 3 | 0.057 | 0.19 | 1.02 | 2.60 (4 days) |
| 8 | 0.045 | 0.21 | 0.63 | 0.95 |
| 10 | 0.055 | 0.07 | 0.64 | — |
| 15 | 0.055 | 0.19 | 0.65 | — |
| 25 | 0.060 | 0.14 | 0.85 | — |
| 38 | 0.048 | 0.186 | 0.736 | 1.1 (28 days) |
| Couples Without Electrical Resistance Lowering Conductive Coating | | | | |
| 0 | 0.15 | 0.55 | 4.4 | — |
| 4 | 9.58 | 2.80 | 50.5 | 170 |
| 6 | 7.33 | 63.50 | 60.5 | 190 (8 days) |
| 11 | 8.05 | 142.5 | 35-100 | — |
| 17 | 10.50 | 135.6 | 60-70 | — |
| 27 | 6.95 | 7.0 | 65 | 130 (28 days) |

EXAMPLE V

One inch square couples of titanium and copper and nickel and copper of the thickness and grade described in Example I were mated together using a silver-filled epoxy that is solvent-based and heat cured. The adhesive is a two-component adhesive that is electrically conductive. The couples were cured at about 100° C. for one hour under an applied load of about 100 psi. Two samples of each couple were initially employed and electrical resistance was measured using the procedure explained in Example I. Resistance was also recorded after the couples had been aged at about 90° C. for one day. Initial shear strengths were in excess of 500 psi. These couples show a range of resistance values in milliohms which did not tend to increase significantly over a short period of time. These results are shown in Table 3.

TABLE 3

| Couple | Electrical Resistance (milliohms) Initial | 1 Day |
|---|---|---|
| Cu—Ni | 0.1, 0.1 | 0.2, 0.2 |
| Ti—Cu | 2.1, 2.4 | 2.1, 2.4 |

EXAMPLE VI

One inch square coupons of nickel and copper of the thickness and grade described in Example I were selected, cleaned as described in Example I and mated or coupled together. Prior to mating a uniform film of a conductive coating of the type described in Example II was applied to the mating surface of both coupons, except for a ⅛ inch wide strip along three sides. In this ⅛ inch strip on both coupons a copper-filled, single component epoxy adhesive was applied in a uniform thin film. Three couples of nickel-copper coupons were thus formed and were cured for about 30 minutes at about 150° C. The couples were subjected to less than 50 pounds per square inch pressure during curing. Aging was conducted at about 90° C. to simulate conditions in an operating filter press membrane electrolytic cell of the chlor-alkali type. The following table shows the electrical resistance in milliohms measured in the manner described in Example I. The shear stress load of the bonds between the couples was measured for couple

#1 as 60 pounds on Day 1 and for couple #3 as 72 pounds on Day 70. No measurement was made for couple #2.

TABLE 4

| Aging Time (Days) | Resistance (Milliohms) Cu/Ni #1 | Cu/Ni #2 | Cu/Ni #3 |
|---|---|---|---|
| 1 | .122 | .124 | .117 |
| 5 | — | .121 | .133 |
| 30 | — | .118 | .128 |
| 70 | — | .110 | .110 |

EXAMPLE VII

One inch square coupons of copper, nickel and titanium of the thickness and grade described in Example I were selected, cleaned as described in Example I and mated or coupled together to form three sets each of copper-nickel and copper-titanium couples. Prior to mating, a uniform film of a conductive coating of the type described in Example III was applied to the mating surface of the copper coupon of each couple. A uniform film of a copper-filled, single component epoxy adhesive was applied to the entire surface of the nickel and titanium coupons. The couples were cured under 50 pounds per square inch pressure for 30 minutes at 145° C. The couples were aged at about 90° C. The following table shows the electrical resistance in milliohms measured in the manner described in Example I.

The shear stress load of the bonds between the couples were measured at various times. Copper-nickel couple #1 had 415 pounds on Day 1, copper-nickel couple #2 had 620 pounds on Day 70, and copper-nickel couple #3 was not measured. Copper-titanium couple #1 had a shear stress load of 670 pounds on Day 1, copper-titanium couple #3 had 510 pounds on Day 70, and copper-titanium couple #2 was not measured.

The data suggests that the copper-filled single component epoxy adhesive did not protect the surface of the nickel and titanium coupons from oxidation.

TABLE 5

| Couple | Resistance (Milliohms) at Various Aging Times (Days) Day 1 | Day 30 | Day 70 | Shear Stress Load (Pounds) |
|---|---|---|---|---|
| Cu/Ni #1 | .280 | — | — | 415 (Day 1) |
| Cu/Ni #2 | .185 | .165 | .175 | 620 (Day 70) |
| Cu/Ni #3 | .500 | .650 | 1.120 | — |
| Cu/Ti #1 | 6.1 | | | 670 (Day 1) |
| Cu/Ti #2 | 18.6 | 34.2 | 52.5 | — |
| Cu/Ti #3 | 2.9 | 3.9 | 4.5 | 510 (Day 70) |

EXAMPLE VIII

A 0.15 square meter filter press membrane chlor-alkali electrolytic cell employing a half anode and half cathode was fabricated. The electrodes were formed by utilizing diffusion bonding of a mesh electrode surface to generally vertical electrical conducting elements or blades and the blades to the backplates. The electrode subunits were mounted to copper conducting plates with adhesives. The anode was titanium and was bonded to its conducting plate using a copper-filled, single-component epoxy after the mating surfaces were cleaned as described in Example I. A conductive coating of the type described in Example III that lowers the electrical resistance at the joint or interface was applied to the backplate in line with the conducting blades prior to mating the conducting plate to the backplate. The cathode assembly was formed from a nickel electrode subunit soldered to the copper conducting plate with a 95% tin, 5% silver solder compound. A nickel sheet was soldered with the same solder material to the opposing side of the copper conducting plate to control the bimetallic expansion that results from heating.

The cell was initially operated at a current density of about 2.4 kiloamperes per square meter. The cell performance averaged 3.04 volts and 94.9% current efficiency with a DC power consumption of 2148 kilowatt hours per metric ton of caustic produced. The cell employed a FLEMION® 757 membrane, 229 grams per liter of NaCl in anolyte, and operated at a temperature of 88° C., to produce a 34.92% concentrated caustic.

Voltage losses normalized to a current density of 3 kiloamperes per square meter were 5 millivolts through the anode and 1 millivolt through the cathode.

EXAMPLE IX

A 0.15 square meter filter press membrane electrolytic cell employing a half anode and a half cathode was fabricated. The electrodes were formed by utilizing diffusion bonding of a mesh electrode surface to generally vertical electrical conducting elements or blades and the blades to the backplates. The electrode subunits were mounted to copper conducting plates with adhesives. The titanium anode subunit was bonded to its conducting plate using the copper-filled, single-component epoxy of Example VI, after the mating surfaces were cleaned as described in Example I. A conductive coating of the type identified in Example III that lowers the electrical resistance was applied to the reverse side of the backplate in line with the conducting blades prior to mating the conducting plate to the backplate. The cathode was formed from an electrode subunit of nickel adhesively bonded to the copper conducting plate with a two-component, low viscosity, non-conductive epoxy adhesive system combined with a conducting coating that lowers the electrical resistance between the subunit backplate and the copper conducting plate. The conductive coating was applied as with the anode. The mating of the surfaces of the backplates and the copper conducting plates also employed a pressure contact joint that is a silver plated berylium copper sold commercially under the ELECTROMATE tradename.

The cell was operated with pumped electrolyte circulation and a FLEMION® 757 membrane. For the first 16 days of operation cell performance averaged 3.31 volts and 94.9% current efficiency at 3.6 kiloamperes per square meter current density. Cell performance for the next 14 days of operation ranged from about 93.5% to about 95% current efficiency at current densities between about 4.5 and about 5.0 kiloamperes per square meter. After 74 days of operation hardware voltage losses at 6.0 kiloamperes per square meter were 8.5 millivolts for the anode and 8.5 millivolts for the cathode. Voltage losses normalized to 3.0 kiloamperes per square meter were 4.5 millivolts for the anode and 4.5 millivolts for the cathode.

While the preferred structure made by the diffusion bonding process in which the principles of the present invention have been incorporated is shown and described above, it is to be understood that the invention is not to be limited to the particular details thus presented, but in fact, widely different means may be employed in the practice of the broader aspects of this invention. For example, it is possible to metallurgically bond the electrode surface 11 to the electrical conducting element 14 or 20 by the diffusion bonding technique and then bond the combined electrode surface-electrical conducting elements to the backplate 16 by means of one of the adhesives disclosed and discussed herein in combination with the conductive coating also discussed. The conductive coating would then be applied along the center line of the conducting elements with the adhesive applied along the outer sides of the conducting element surface to be mated to the backplate.

It is possible to assemble the electrode subunits without the use of any adhesives by assembling the electrodes in a horizontally oriented, vertically rising stack and then compressing the assembled electrode stack. The stack could then be rotated 90° to a vertical orientation and operated.

It is to be understood also that although only a half electrode is shown in FIGS. 2–5, the electrode can equally well be a full electrode with two active surfaces on opposing sides. The full electrode may be either monopolor or bipolar. The full electrode would then merely have the electrode subunits 10 or 18 on both sides of the electrical conducting plate 19 with the desired adhesive and conductive coating application applied to both backplates in the manner described with reference to FIG. 3 prior to applying the backplates 16 to both sides of the conducting plate 19. It is also possible in a bipolar configuration to adhesively bond the cathode subunit, for example made of nickel, directly to the anode subunit, for example made of titanium, utilizing the conductive coating and omitting the conducting plate. Further, it should also be understood that the diffusion bonded electrode subunits 10 or 18 can be employed in electrolytic cells in frames that are metallic, such as of nickel composition for the cathodes and titanium for the anodes, or other appropriate metals. Alternately, these electrode subunits 10 or 18 could be employed in cells using non-metallic cathode frames and metallic anode frames and gaskets, or vice versa.

Further, it should be understood that the electrode subunits and the electrodes produced by the processes described in this disclosure may be used in any type of electrolytic process with or without separators, as appropriate, whether the electrolytic separators are ion selectively permeable membranes or diaphragms. The electrode subunits and electrodes are not to be limited to just utilization in chlor-alkali cells. For example they could be employed in water electrolysis cells, whether employing alkaline or acid electrolytes, HCl electrolyzers, fuel cells, whether employing molten carbonate or phosphoric acid electrolytes, electrowinning cells for lead, copper, zinc, nickel or manganese, and electroplating cells for nickel, chromium and copper.

The scope of the appended claims is intended to encompass all obvious changes in the details, materials, arrangement of parts and processes which will occur to one of skill in the art upon a reading of the disclosure.

What is claimed is:

1. An electrolytic cell for electrolyzing electrolytes having raw materal infeed lines and product outlet lines connected to an electrical power source and having an ion selectively permeable membrane separating each adjacent pair of electrodes, comprising in combination:

(a) a plurality of electrode frames with internal surfaces in contact with the electrolytes, the raw material and the product, the electrode frames further having an unfilled central space;

(b) protective liner material lining the internal surfaces to prevent th electrolytes, raw material and product from directly contacting the elastomeric electrode frame;

(c) an electrode subunit fitted within the central space of each electrode frame containing at least one electrode surface, conducting elements and a backplate, the at least one electrode surface being formed of a corrosion resistant material metallurgically bonded by diffusion bonding to the conducting elements to form electrode surface-conducting element joints that do not abrade the adjacent membrane;

(d) a conducting plate mated to the backplate, the backplate further having a conductive coating applied thereto in line with the conducting elements to lower the electrical resistance between the conducting plate and the backplate prior to mating the conducting plate and the backplate, the conducting plate and the backplate further being mated by an adhesive applied to the backplate; and (e) a coating applied to the at least one electrode surface of each electrode subunit to promote the electrolyzing of the electrolytes.

2. The apparatus according to claim 1 wherein the electrode frames have a plurality of top internal flow conduits above the electrode subunit for the flow of the product fluids to the product outlet lines.

3. The apparatus according to claim 2 wherein the electrode frames further have at least one of the plurality of top internal flow conduits in fluid flow communication with the unfilled central space by at least one upper internal flow passage.

4. The apparatus according to claim 3 wherein the electrode frames have a plurality of bottom internal flow conduits below the electrode subunit for the flow of the raw material infeed therethrough to the unfilled central space and the electrode subunit.

5. The apparatus according to claim 4 wherein the electrode frames have at least one of the plurality of bottom internal flow conduits connected to the unfilled central space by at least one lower internal flow passage.

6. The apparatus according to claim 5 wherein the electrode frames are non-metallic.

7. The apparatus according to claim 6 wherein the electrode frames are elastomeric.

8. The apparatus according to claim 1 wherein the conducting elements are metallurgically bonded by diffusion bonding to the backplate.

9. The apparatus according to claim 1 wherein the conducting elements are bonded to the backplate by an adhesive.

10. The apparatus according to claim 1 wherein the electrodes are bipolar.

11. The apparatus according to claim 1 wherein the electrodes are monopolar.

12. The apparatus according to claim 1 wherein the coating applied to the electrode surface is a catalytically active or high surface area coating.

13. The apparatus according to claim 1 wherein the electrode subunit is heated during diffusion bonding to a temperature of about 871° C. to about 954° C. and subjected to a pressure of about 200 to about 350 pounds per square inch for at least about 60 to about 90 minutes.

14. The apparatus according to claim 13 wherein the corrosion resistant material is nickel.

15. Te apparatus according to claim 1 wherein the electrode subunit is heated during diffusion bonding to a temperature of about 815° C. to about 898° C. and is subjected to a pressure of about 200 to about 300 pounds per square inch for at least about 60 to about 90 minutes.

16. The apparatus according to claim 15 wherein the corrosion resistant material is at least partially titanium.

17. The apparatus according to claim 1 wherein the conducting elements in the electrode subunit are superplastically formed.

18. The apparatus according to claim 17 wherein the conducting elements are superplastically formed in an atmosphere of inert gases at a breakthrough pressure of about 4 pounds per square inch to about 64 pounds per square inch with a stopoff compound applied to the backplate in the areas to be superplastically formed.

19. The apparatus according to claim 1 wherein the conductive coating consists of about 20% to about 30% by weight indium and about 80% to about 70% by weight gallium.

20. The apparatus according to claim 1 wherein the adhesive is a non-conductive adhesive.

21. The apparatus according to claim 1 wherein the adhesive is a conductive adhesive.

22. The apparatus according to claim 21 wherein the adhesive is selected from the group consisting of a two-component silver-filled epoxy, a single component copper-filled epoxy or a two-component copper-filled epoxy.

* * * * *